US006932188B2

(12) United States Patent
Ni

(10) Patent No.: US 6,932,188 B2
(45) Date of Patent: Aug. 23, 2005

(54) SILENCER FOR VACUUM CLEANER

(75) Inventor: Zugen Ni, Suzhou (CN)

(73) Assignee: Suzhou Kingclean Floorcare Co., Ltd., Suzhou (CN)

( * ) Notice: Subject to any disclaimer, the term of this patent is extended or adjusted under 35 U.S.C. 154(b) by 0 days.

(21) Appl. No.: 10/726,061

(22) Filed: Dec. 2, 2003

(65) Prior Publication Data

US 2005/0045417 A1 Mar. 3, 2005

(30) Foreign Application Priority Data

Aug. 26, 2003 (CN) ..... 03152868 A

(51) Int. Cl.[7] ..... F01N 3/02; F01N 1/04; F01N 1/24; A47L 9/10; B01D 39/08

(52) U.S. Cl. ..... 181/231; 181/249; 181/255; 181/258; 181/269; 181/281; 15/326; 96/382; 96/388; 96/381; 96/387

(58) Field of Search ..... 181/231, 249, 181/255, 258, 269, 270, 281, 282, 222, 252, 256; 15/326, 353; 417/312; 96/382, 388, 381, 385, 387

(56) References Cited

U.S. PATENT DOCUMENTS

| | | | | | |
|---|---|---|---|---|---|
| 1,023,225 | A | * | 4/1912 | Shlosberg | 181/269 |
| 1,682,316 | A | * | 8/1928 | Williams | 181/281 |
| 2,656,004 | A | * | 10/1953 | Olson | 181/295 |
| 2,748,883 | A | * | 6/1956 | Ralph | 181/258 |
| 3,381,774 | A | * | 5/1968 | Stade et al. | 181/272 |
| 3,677,364 | A | * | 7/1972 | Pawlina | 181/269 |
| 3,688,868 | A | * | 9/1972 | Gibel et al. | 181/230 |
| 4,031,979 | A | * | 6/1977 | Raleigh | 181/240 |
| 4,286,976 | A | * | 9/1981 | Eriksson | 96/387 |
| 4,382,487 | A | * | 5/1983 | Baumann | 181/282 |
| 4,474,260 | A | * | 10/1984 | Valentine | 181/230 |
| 5,067,584 | A | | 11/1991 | Williams et al. | |
| 5,159,738 | A | | 11/1992 | Sunagawa et al. | |
| 5,513,417 | A | | 5/1996 | Kim et al. | |
| 5,532,439 | A | * | 7/1996 | Minkin | 181/224 |
| 5,991,969 | A | | 11/1999 | Lee | |
| 6,035,485 | A | | 3/2000 | Holsten | |
| 6,094,774 | A | | 8/2000 | Larsen et al. | |
| 6,152,258 | A | * | 11/2000 | Deavers et al. | 181/282 |

FOREIGN PATENT DOCUMENTS

| | | | | | |
|---|---|---|---|---|---|
| DE | 4203128 | A1 | * | 8/1992 | B01D/39/20 |
| JP | 56050283 | A | * | 5/1981 | F04B/39/00 |
| JP | 04350317 | A | * | 12/1992 | F01N/3/02 |
| WO | WO 2004/052165 | A1 | * | 6/2004 | A47L/9/00 |

* cited by examiner

*Primary Examiner*—Edgardo San Martin
(74) *Attorney, Agent, or Firm*—Dorsey & Whitney LLP

(57) ABSTRACT

A silencer for a vacuum cleaner is provided and includes at least one hermetic expansion chamber mounted in an exhaust channel of the vacuum cleaner and allowing an exhaust airflow from the vacuum cleaner to pass through. The expansion chamber at its two sides has an inlet and an outlet connected to the exhaust channel. A silencing board is mounted in the expansion chamber, separating the inlet from the outlet. Pores are distributed throughout in the silencing board. The silencer integrates several different silencing structures together, and, when mounted to the exhaust port of the vacuum cleaner, can considerably diminish the noise generated by the vacuum cleaner in operation.

7 Claims, 1 Drawing Sheet

SILENCER FOR VACUUM CLEANER

CROSS-REFERENCE TO RELATED APPLICATION

The following application claims priority to earlier filed Chinese Application No. 03152868.6, filed on Aug. 26, 2003, the contents of which is hereby incorporated in its entirety by reference.

FIELD OF THE INVENTION

The present invention relates to a silencer for a vacuum cleaner.

BACKGROUND OF THE INVENTION

In conventional exhaust silencers for vacuum cleaners, the noise is reduced by means of increasing the tortuosity of the airflow channel, i.e., by using labyrinthic airflow channels, to dissipate sound energy and by means of disposing porous sound-absorbing materials at the turning corners of the airflow channel to absorb sound energy. Poor noise silencing effect, however, is the main disadvantage of the above-mentioned silencing structures.

SUMMARY OF THE INVENTION

The object of the invention is to provide a silencer for a vacuum cleaner which incorporates several different silencing structures. The silencer can be mounted in the exhaust channel of the vacuum cleaner to considerably reduce the noise generated by a vacuum cleaner in operation.

In one aspect of the invention, a silencer for a vacuum cleaner comprises at least one hermetic expansion chamber mounted in an exhaust channel of the vacuum cleaner and allowing an exhaust airflow from the vacuum cleaner to pass through. The expansion chamber at its two sides has an inlet and an outlet connected to the exhaust channel. The cross-sectional area of the expansion chamber in the direction perpendicular to the airflow is larger than that of each of the inlet and the outlet.

In a further aspect of the invention, a silencer for a vacuum cleaner comprises at least one hermetic expansion chamber mounted in an exhaust channel of the vacuum cleaner and allowing an exhaust airflow from the vacuum cleaner to pass through. The expansion chamber at its two sides has an inlet and an outlet connected to the exhaust channel. The cross-sectional area of the expansion chamber in the direction perpendicular to the airflow is larger than that of each of the inlet and the outlet. A silencing board is mounted in the expansion chamber, separating the inlet from the outlet, with a plurality of pores distributed throughout in the silencing board. The expansion chamber is formed by two halves that are oppositely conjoined to each other at a joint, and the silencing board is fixed at the joint.

In a more detailed aspect of the invention, a silencer for a vacuum cleaner comprises at least one hermetic expansion chamber mounted in an exhaust channel of the vacuum cleaner and allowing passage of an exhaust airflow from the vacuum cleaner. The expansion chamber at its two sides has an inlet and an outlet connected to the exhaust channel. The cross-sectional area of the expansion chamber in the direction perpendicular to the airflow of is larger than that of each of the inlet and the outlet. A silencing board is mounted in the expansion chamber, separating the inlet from the outlet, with a plurality of pores distributed throughout in the silencing board. The expansion chamber is formed by two halves that are oppositely conjoined to each other at a joint, and the silencing board is fixed at the joint, The distances from two inner end faces of the expansion chamber, which contain the inlet and the outlet respectively, to the silencing board are both longer than 10 mm and shorter than 100 mm. The cross-sectional area of the expansion chamber in the direction perpendicular to the airflow is larger than double of that outlet. A noise-absorbing material is attached to inner walls of the expansion chamber. A plurality of apertures are drilled around the circumference of each of the inlet and the outlet. The cross-sectional areas of the inlet and the outlet in the direction perpendicular to the airflow are both less than 5000 $mm^2$.

The invention provides the following advantages:

1. The silencer of the invention incorporates several different silencing structures and diminishes the noise generated by the vacuum cleaner in operation via its multi-silencing structure, thereby considerably improving the effect of noise reduction.

2. Several silencers of the invention can be connected in series, which will obtain a much better noise silencing effect.

3. The expansion chamber of the invention can be directly connected to the exhaust channel without the silencing board. The expansion chamber can also be mounted with the silencing board. The expansion chamber mounted with the silencing board can obtain a better effect of noise reduction.

BRIEF DESCRIPTION OF THE DRAWINGS

FIG. 1 is a sectional view schematically illustrating a silencer for a vacuum cleaner according to a preferred embodiment of the invention, wherein:

Figure 1:
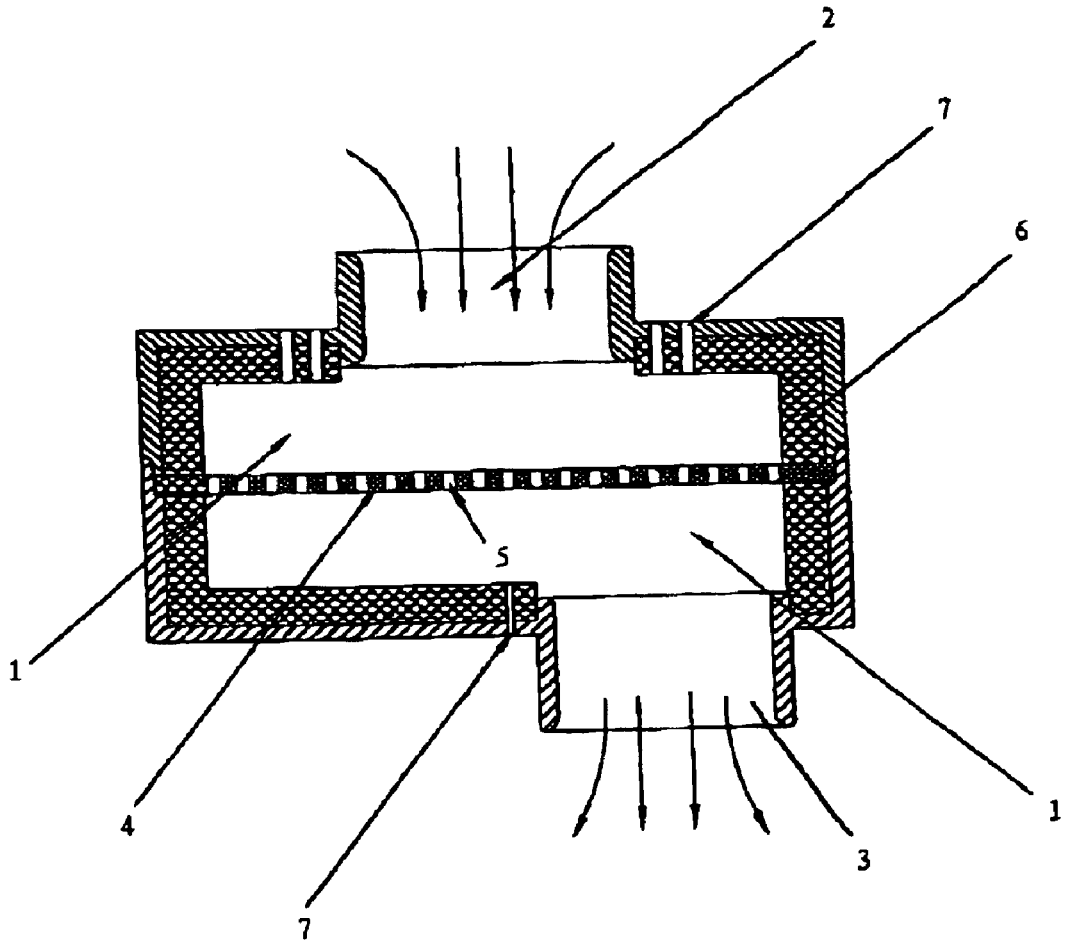

the numeral 1 denotes an expansion chamber, 2 denotes an inlet, 3 denotes an outlet, 4 denotes a silencing board, 5 denotes pores, 6 denotes a noise-absorbing material, and 7 denotes apertures.

DETAILED DESCRIPTION OF THE PREFERRED EMBODIMENT

The present invention is described bellow with reference to the preferred embodiment of the invention shown in FIG. 1.

As shown in FIG. 1, a silencer for a vacuum cleaner comprises at least one hermetic expansion chamber 1 mounted in an exhaust channel of the vacuum cleaner and allowing an exhaust airflow from the vacuum cleaner to pass through. The expansion chamber 1 at its two sides has an inlet 2 and an outlet 3 connected to the exhaust channel. The cross-sectional area of the expansion chamber 1 in the direction perpendicular to the airflow is larger than that of each of the inlet 2 and the outlet 3. A silencing board 4, which is generally made of plastic material or metal, is mounted in the expansion chamber 1 for separating the inlet 2 from the outlet 3, and a plurality of pores 5 are distributed throughout in the silencing board 4. The expansion chamber 1 is formed by two halves that are oppositely conjoined to each other at a joint, and the silencing board 4 can be mounted at the joint. The distances from two inner end faces of the expansion chamber 1, which contain the inlet 2 and the outlet 3 respectively, to the silencing board 4 are both longer than 10 mm and shorter than 100 mm. The cross-sectional area of the expansion chamber 1 in the direction perpendicular to the airflow is larger than double of that of the outlet 3. A noise-absorbing material is attached to inner walls of the expansion chamber 1. A plurality of apertures 7 are drilled around the circumference of each of the inlet 2 and the outlet 3. The cross-sectional areas of the inlet 2 and the outlet 3 in the direction perpendicular to the airflow are both less than 5000 $mm^2$.

In operation, the airflow discharged from the vacuum cleaner first flows into the front half of the expansion chamber 1 through the inlet 2. The sudden enlargement of the cross section results in the effect of noise reducing. Meanwhile, the noise-absorbing material 6 attached to the inner walls of the expansion chamber 1 also absorbs an amount of sound energy, which can also reduce the noise. Then, the airflow passes through the silencing board 4 which is densely distributed with pores 5, and the sound energy is further diminished. Thereafter, the airflow and the sound waves enter the rear half of the expansion chamber 1, and the reduced noise is still further diminished. If there is enough room, several expansion chambers 1 can be connected in series, which will further improve the noise silencing effect. The expansion chamber 1 of the invention can be directly connected to the exhaust channel of the vacuum cleaner. The expansion chamber 1 can also be mounted with the silencing board 4. The expansion chamber 1 with the silencing board 4 can obtain a better effect of noise reduction.

What is claimed is:

1. A silencer for a vacuum cleaner, which comprises at least one hermetic expansion chamber mounted in an exhaust channel of the vacuum cleaner and allowing an exhaust airflow from the vacuum cleaner to pass through, the expansion chamber having opposite sides spaced apart from each other in the direction of the exhaust airflow, the expansion chamber said opposite sides having an inlet and an outlet respectively connected to the exhaust channel, the cross-sectional area of the expansion chamber in the direction perpendicular to the airflow being larger than that of each of the inlet and the outlet, and a plurality of apertures being drilled around the circumference of each of the inlet and the outlet.

2. A silencer for a vacuum cleaner according to claim 1 wherein a silencing board is mounted in the expansion chamber, separating the inlet from the outlet, with a plurality of pores distributed throughout in the silencing board.

3. A silencer for a vacuum cleaner according to claims 1 or 2 wherein the expansion chamber is formed by two halves that are oppositely conjoined to each other at a joint, and the silencing board is fixed at the joint.

4. A silencer for a vacuum cleaner according to claim 1 wherein the distances from two inner end faces of the expansion chamber, which contain the inlet and the outlet respectively, to the silencing board are both longer than 10 mm and shorter than 100 mm.

5. A silencer for a vacuum cleaner according to claim 1 wherein the cross-sectional area of the expansion chamber in the direction perpendicular to the airflow is larger than double of that of the outlet.

6. A silencer for a vacuum cleaner according to claim 1 wherein a noise-absorbing material is attached to inner walls of the expansion chamber.

7. A silencer for a vacuum cleaner according to claim 1 wherein the cross-sectional areas of the inlet and the outlet in the direction perpendicular to the airflow are both less than 5000 $mm^2$.

* * * * *